US005175025A

United States Patent [19]

Asano

[11] Patent Number: 5,175,025

[45] Date of Patent: Dec. 29, 1992

[54] SIZING AGENT FOR CARBONIZABLE FIBER AND A METHOD FOR MANUFACTURING CARBON FIBER WITH THE USE OF THE SIZING AGENT

[76] Inventor: Hiroyoshi Asano, 5-204 Tenjin Heights, 1-3 Hachijogaoka, Nagaokakyo-city, Kyoto, Japan

[21] Appl. No.: 648,955

[22] Filed: Feb. 1, 1991

[30] Foreign Application Priority Data

Feb. 5, 1990 [JP] Japan ..... 2-25556

[51] Int. Cl.[5] ..... B05D 3/02

[52] U.S. Cl. ..... 427/227; 427/228; 427/385.5; 427/389.9; 427/421; 427/434.2

[58] Field of Search ..... 427/227, 228, 421, 434.2, 427/385.5, 389.9

[56] References Cited

U.S. PATENT DOCUMENTS 3,607,672 9/1971 Schmitt ..... 427/227
3,632,391 1/1972 Whitfield et al. ..... 427/393.2
3,723,157 3/1973 Druin ..... 427/227

*Primary Examiner*—Janyce Bell
*Attorney, Agent, or Firm*—Jordan and Hamburg

[57] ABSTRACT

Sizing agent for carbonizable fiber contains a high molecular compound having a weight average molecular weight of not less than 10,000 as obtainable by reacting (A) a polyalkylene oxide compound having a weight average molecular weight of not less than 100 as obtainable by addition-polymerizing an ethylene oxide-containing alkylene oxide with an organic compound containing two active hydrogen groups with (B) a polycarboxylic acid or the corresponding anhydride or lower alkyl ester or a diisocyanate. The sizing agent not only inhibits napping and binds fiber but, because of its good thermal decomposition behavior, does not cause glueing of fiber so that a substantial upgrading of carbon fiber is achieved without detracting from its strength. Furthermore, as the sizing agent does not become a tar, deposits within the carbonizing furnace are minimized and the trouble of furnace obstruction prevented.

2 Claims, No Drawings

SIZING AGENT FOR CARBONIZABLE FIBER AND A METHOD FOR MANUFACTURING CARBON FIBER WITH THE USE OF THE SIZING AGENT

BACKGROUND OF THE INVENTION

1. Technical Field

The present invention relates to a sizing agent for carbonizable fiber and a method for manufacturing carbon fiber with the sizing agent.

2. Prior Art

In the course of manufacture of carbon fiber, the fiber is liable to undergo napping due to contact with guide rolls and so on.

To prevent napping, therefore, a flame-resistant fiber (such as an oxidizing acrylic fiber) or non-fusible fiber (such as a graphitizing infusible pitch fiber) is generally coated with a sizing agent prior to carbonization (Japanese Patent Publication No. 64-6288).

As sizing agents, there has been proposed a variety of water-soluble materials such as starch, processed starch, dextrin, amylose, carboxymethyl-cellulose, polyvinyl alcohol, water-soluble polyurethane resin and so on.

However, these hitherto-known sizing agents have one or more of the following disadvantages, viz. (1) poor solubility in water, (2) a too stiff film produced, (3) not easily decomposed on heat treatment, (4) large amounts of ash remain which as an impurity detrimentally affect the physical properties of the carbon fiber.

OBJECT OF THE INVENTION

The object of the present invention is to provide a sizing agent free from the above-mentioned disadvantages, viz. a sizing agent which is readily soluble in water, yields a flexible film, is readily decomposed on heat treatment, and leaves a minimum of ashes.

SUMMARY OF THE INVENTION

The sizing agent for carbon fiber according to the present invention is characterized in that it contains a high molecular compound having a weight average molecular weight of not less than 10,000 which can be prepared by reacting (A) a polyalkylene oxide compound having a weight average molecular weight of not less than 100 as obtainable by addition-polymerizing an ethylene oxide-containing alkylene oxide with an organic compound containing two active hydrogen groups with (B) a polycarboxylic acid or the corresponding anhydride or lower alkyl ester or a diisocyanate.

The method for manufacturing carbon fiber using the above sizing agent comprises the following sequential steps:

(1) a step in which said sizing agent is dissolved in water;

(2) a step in which a flame-resistant or non-fusible fiber is dipped in an aqueous solution prepared in step (1) or sprayed with the same aqueous solution;

(3) a step in which the coated fiber is dried; and (4) a step in which the dried fiber is carbonized by heating.

DETAILED DESCRIPTION OF THE INVENTION

The organic compound containing two active hydrogen groups, which as aforesaid is used for the synthesis of the high molecular compound to be incorporated in the sizing agent according to the invention, includes, inter alia, ethylene glycol, propylene glycol, polyethylene glycol, polypropylene glycol, butylamine, polytetramethylene glycol, aniline and so on.

The ethylene oxide-containing alkylene oxide to be addition-polymerized with said organic compound containing two active hydrogen groups includes, inter alia, ethylene oxide as such or various mixtures of ethylene oxide with one or more other alkylene oxides such as propylene oxide, butylene oxide, styrene oxide, $\alpha$-olefin epoxides, glycidyl ethers and so on. The modes of addition may be block and random.

The addition-polymerization of said alkylene oxide to said organic compound can be carried out in the per se known manner.

The polyalkylene oxide compound produced by such addition-polymerization reaction should have a weight average molecular weight of at least 100. If the weight average molecular weight is less than 100, the object of the invention may not be accomplished.

The polycarboxylic acid or the anhydride or lower alkyl ester thereof, which is reacted with said polyalkylene oxide compound, includes, inter alia, phthalic acid, isophthalic acid, terephthalic acid, sebacic acid, pyromellitic acid, tetracarboxylic acid, etc., and the corresponding acid anhydrides and dimethyl, diethyl and other esters.

The diisocyanate to be reacted with said polyalkylene oxide compound includes any and all diisocyanates which are commonly used in the art, such as tolylene diisocyanate, hexamethylene diisocyanate, isophorone diisocyanate and so on. Furthermore, the so-called prepolymers obtainable by reacting polypropylene glycol, for instance, with such diisocyantes can also be used as said diisocyanate.

The polyester-forming reaction between the polyalkylene oxide compound and the polycarboxylic acid or the corresponding anhydride or lower alkyl ester and the polyurethane-forming reaction between the polyalkylene oxide compound and the diisocyanate tend to be accompanied by thermal decomposition and, therefore, these reactions are preferably conducted in a closed reactor.

The charging ration of said polyalkylene oxide compound to said polycarboxylic acid, anhydride or lower alkyl ester or diisocyanate is virtually optional, provided that the weight average molecular weight of the product high molecular compound is not less than 10,000.

The carbon fiber which can be manufactured using the sizing agent of the invention includes, inter alia, the polyacrylonitrile type, rayon type, pitch type and other carbon fibers which are generally known, and may be carbonaceous or graphitic.

The high molecular compound of the invention is preferably use dina proportion of 0.1 to 10 weight % based on the flame-resistant or non-fusible fiber. It is used in the form of aqueous solution.

Where appropriate, it can be used in combination with other sizing agents such as starch and starch derivatives, carboxymethylcellulose, polyvinyl alcohol, polyacrylic acid and so on.

Furthermore, other additives such as plasticizers, emulsifiers, leveling agents, antistatic agents, etc. can also be incorporated in appropriate amounts.

For use as a sizing agent for carbon fiber, the high molecular compound of the invention is dissolved in water and a flame-resistant or non-fusible fiber is then dipped in the solution or sprayed therewith.

The sized fiber is fed to a carbonizing step via a drying step. In the carbonizing step, fiber degreasing is simultaneously effected. This degreasing is preferably carried out at a comparatively low temperature from the standpoint of preventing thermal degradation of the carbon fiber or a temperature sufficiently high to completely decompose the organic matter from the standpoint of preventing contamination with impurities which might adversely affect the physical properties of the finished carbon fiber The sizing agent of the invention si advantageous in that it is almost completely decomposed within 2 hours at 300° to 350° C. and does not leave tarry residues.

The high molecular compound contained in the sizing agent of the invention is readily soluble in water, yields a flexible film, is readily decomposed on heat treatment, and leaves a minimum of ashes.

Therefore, the sizing agent of the invention not only acts as an efficient binder for preventing the incidence of napping but, because of its good thermal decomposition behavior, does not cause glueing of filaments during carbonization so that the final fiber may have a substantially improved quality without loss of fiber strength. Moreover, this sizing agent not only prevents napping but is not converted to a tar so that the amount of deposits fouling the carbonizing furnace are decreased and obstruction of the furnace is precluded.

PREFERRED EMBODIMENTS OF THE INVENTION

The following examples and comparative example are intended to illustrate the invention in further detail and should by no means be construed as defining the metes and bounds of the invention.

EXAMPLE 1

One-hundred (100) parts by weight of polyethylene glycol (weight average molecular weight 10,000) was reacted with 2.2 parts by weight of dimethyl terephthalate to give a compound with a weight average molecular weight of 130,000 (hereinafter referred to as high molecular compound A).

In 1000 ml of water was dissolved 2 g of the above high molecular compound A and 1 g of sorbitan oleate which is a leveling agent, and a flame-resistant polyacrylonitrile fiber was dipped in the resulting solution and dried at 110° C. (coating amount: 0.4 weight % of fiber bundle).

The coated fiber was carbonized in a carbonizing furnace in the presence of nitrogen gas at 1,400° C. As a result, neither napping of the fiber nor drippings of tarry matter were encountered. The resulting carbon fiber had a tensile strength of 410 kg/mm$^2$, an elastic modulus of 24.5 T/mm$^2$ and an elongation of 1.7%.

EXAMPLE 2

One hundred (100) parts by weight of polypropylene glycol (weight average molecular weight 2,000) was addition-polymerized with 1,900 parts by weight of ethylene oxide, followed by reaction with 20 parts by weight of dimethyl sebacate to provide a compound having a weight average molecular weight of 200,000 (hereinafter referred to as high molecular compound B).

Using this high molecular compound B, a sizing solution was prepared in the same manner as in Example 1. A graphitizing infusible pitch fiber was dipped in this solution, dried and carbonized in a nitrogen gas stream at 1,200° C. The tensile strength of this carbon fiber was 250 kg/mm$^2$. No drippings were found.

COMPARATIVE EXAMPLE 1

The procedure of Example 1 was repeated except that polyvinyl alcohol (degree of polymerization 500; degree of saponification 88%) was used in lieu of the high molecular compound A used in Example 1. The tensile strength of the resulting carbon fiber was 250 kg/mm$^2$.

COMPARATIVE EXAMPLE 2

The procedure of Example 2 was repeated except that the same polyvinyl alcohol as used in Comparative Example 1 was use din lieu of high molecular compound B used in Example 2 to provide a carbon fiber. The tensile strength of this carbon fiber was 150 kg/mm$^2$.

In both Comparative Examples 1 and 2, nap and tarry matter were produced and drippings soiled the interior of the carbonizing furnace.

What is claimed is:

1. A method for manufacturing carbon fiber comprising the following sequential steps:

(1) a step in which a sizing agent comprising a high molecular compound having a weight average molecular weight of not less than 10,000 as obtainable by reacting (A) a polyalkylene oxide compound having a weight average molecular weight of not less than 100 as obtainable by addition-polymerizing an ethylene oxide-containing alkylene oxide with an organic compound containing two active hydrogen groups with (B) a polycarbonic acid or the corresponding anhydride or lower alkyl ester or a diisocyanate is dissolved in water;

(2) a step in which a flame-resistant or non-fusible carbonizable fiber is dipped in an aqueous solution prepared in step (1) or sprayed with the same aqueous solution;

(3) a step in which the fiber is dried; and (4) a step in which the dried fiber is carbonized by heating.

2. A method according to claim 1, in which the proportion of said high molecular compound on the carbonizable fiber upon completion of steps (2) and (3) is 0.1 to 10 weight % based on the carbonizable fiber.

* * * * *